US005588604A

United States Patent [19]

Vetter et al.

[11] Patent Number: 5,588,604

[45] Date of Patent: Dec. 31, 1996

[54] DEVICE FOR TRANSPORTING YARN WITH A CENTRAL MAST

[75] Inventors: Gerhard Vetter, Süssen; Eberhard Markert, Rechberghausen, both of Germany

[73] Assignee: Michael Horauf Maschinenfabrik GmbH & Co. KG, Donzdorf, Germany

[21] Appl. No.: 420,766

[22] Filed: Apr. 12, 1995

[30] Foreign Application Priority Data

Apr. 12, 1994 [DE] Germany ..... 44 12 433.3

[51] Int. Cl.[6] ..... B65H 51/24

[52] U.S. Cl. ..... 242/47.05; 242/47.04

[58] Field of Search ..... 242/47.05, 47.04, 242/47.01; 28/247

[56] References Cited

U.S. PATENT DOCUMENTS 2,136,566 11/1938 Lovett ..... 242/47.1
2,388,591 11/1945 Andreas ..... 28/71.5
4,414,756 11/1983 Simpson et al. ..... 242/47.01
4,860,999 8/1989 Ritter et al. ..... 242/47.01
4,919,395 4/1990 Ritter et al. ..... 242/47.01

FOREIGN PATENT DOCUMENTS

0047468B2 3/1982 European Pat. Off. .

*Primary Examiner*—William Stryjewski
*Attorney, Agent, or Firm*—Evenson McKeown Edwards & Lenahan, PLLC

[57] ABSTRACT

A device for transporting yarn comprises a central mast which is equipped with a plurality of circulating transport belts which are arranged when viewed in cross section in polygonal form. At least one yarn is wound around the transport belts and the central mast in controlled loops by means of a winding flyer, whereby the central mast is supported in a mounting on its end towards the winding flyer. In the area of its other end, the central mast is provided with supported rollers, which are supported by a supporting roller arranged outside the loops. The supporting roller and the transport belts are each provided with their own drives. The speeds of the transport belts, the supported rollers and the supporting roller can thus be synchronized exactly with each other.

25 Claims, 4 Drawing Sheets

DEVICE FOR TRANSPORTING YARN WITH A CENTRAL MAST

BACKGROUND AND SUMMARY OF THE INVENTION

The invention relates to a device for transporting yarn, said device comprising a central mast, which is equipped with a plurality of circulating transport belts arranged in a polygonal pattern when viewed in cross section. At least one yarn is wound around the central mast and the transport belts in controlled loops by means of a winding flyer. The central mast is supported in a mounting on its end towards the winding flyer and in the area of its other end it is provided with supported rollers, which are supported by a supporting roller which is located outside the loops. The supporting roller is connected to a roller drive and the circumferential speeds of the supported rollers are synchronized with the circumferential speed of the supporting roller in preferred embodiments of the invention.

In the case of a device of the general type with which this invention is concerned (European patent 47 468), the central mast is equipped with two lateral friction wheels which are driven by a driven supporting roller. The friction wheels, which function as supported rollers, are tightly connected equiaxially with guiding rollers for the transport belts, so that the latter are also driven. Each transport belt is wound around the relevant guiding roller at an angle of 270°, the transport belt being then driven by the supporting roller over the frictional wheel and the guiding roller. The loops of the yarn are nipped between the supporting roller and the friction wheels serving as supported rollers. As the diameter of the guiding rollers is somewhat smaller than the diameter of the friction wheels, there exists a relative speed between the supporting roller and the yarn loops transported on the transport belt. Because of the drive of the friction wheels, a minimum driving force is necessary, which in certain circumstances must be stronger than the proportionate load caused by the central mast, which has to be supported.

It is an object of the invention to provide, in the case of a device of the type mentioned above, for a more careful handling of the loops of the yarns.

This object is achieved according to preferred embodiments of the invention in that the transport belts are driven by their own belt drive, to which belt speed the circumferential speeds of the supporting roller and the supported rollers are synchronized.

The yarns are more carefully handled during transport due to the fact that the belt drive and the roller drive are adapted to each other to such a degree that no relative speed exists between the loops on the one hand and the supporting roller and the supported rollers on the other. As the drive of the transport belts is not affected by a frictional wheel which presses the loops, the pressure of the supported rollers on the supporting roller can be kept lower and need only be so great that the proportionate weight of the central mast is taken up.

For this purpose the roller drive in especially preferred embodiments of the invention comprises a regulatory, infinitely variable gear. This enables an exact synchronization of the circumferential speeds of the supported rollers and the supporting roller with the belt speed.

It is advantageous according to certain preferred embodiments of the invention to allocate guiding rollers for the transport belts to the supported rollers. The loops of the yarns can then be very precisely laterally guided in the area of the nipping line between the supported rollers and the supporting roller.

The guiding rollers can be constructed in different ways. In one development of the invention it is intended that the supported rollers are at the same time the guiding rollers. Thus an exact synchronization between supported rollers and guiding rollers is guaranteed from the start.

In another development of the invention, the guiding rollers are supported independently of the supported rollers and are freely rotatable. This has the advantage that the supporting of the central mast and the guiding of the transport belts become separate functions.

It is advantageous according to certain preferred embodiments that the guiding rollers are adjustable relative to the supporting roller, so that the guiding rollers fit exactly to the nipping line between the supported rollers and the supporting roller.

According to certain preferred embodiments of the invention, the supported rollers are integral with the guiding rollers as well as coaxially arranged with respect to them and preferably slightly conically shaped on their supported surfaces. This is less recommendable for highly sensitive yarns however, as conical friction surfaces result in different circumferential speeds. In the case of lighter bearing pressures, however, this solution is a very practicable, in particular when the slightly conical supported surfaces are somewhat convex.

In a further development of the invention the supporting roller and/or the supported rollers are provided with an elastic coating. This has the advantage firstly that the loops of the yarns are less crushed when passing the nipping line. An additional advantage is a certain coupling by friction which arises, when required, between the supporting roller and the supported rollers, whereby a synchronization with respect to the circumferential speeds is attained. This friction can of course be less than when the drive of the transport belts has also to be effected by this friction, as is the case with prior art arrangements.

The supported rollers have for the purpose of the invention a supported width which is many times that of the transport belts. The pressing of the loops of the yarns is hereby reduced. To simplify the supporting device, it can be provided that a common axle is allocated to the two supported rollers according to certain preferred embodiments.

It is particularly advantageous when the supporting roller has a larger diameter in the area of the supported rollers. This means that the diameter of the supporting roller is smaller outside of the area of the supported rollers, so that outside of the actual nipping line of the loops, impairment of the loops is reduced. For this purpose the supporting roller for each supported roller has two supporting surfaces, so that a defined two-point support arises.

In a particularly advantageous development of the invention the supporting roller is provided with longitudinal grooves. The loops of the yarns are thus crushed only for a very short time during the run through the nipping line, so that impairment remains at acceptable levels. When the longitudinal grooves of the two supporting surfaces are thereby set at least a half a groove width out of line with respect to each other in a circumferential direction of the supporting roller, it is thus ensured that on one of the two supporting surfaces, the central mast is always actually supported without pinching of the yarn.

It can be further provided according to preferred embodiments that yarn guiding elements are allocated to the supported rollers and/or the guiding rollers. These serve the purpose of bridging any discontinuity spots in the area of the supported rollers or guiding rollers and thus contribute further to the careful treatment of the yarns.

Other objects, advantages and novel features of the present invention will become apparent from the following detailed description of the invention when considered in conjunction with the accompanying drawings.

DETAILED DESCRIPTION OF THE DRAWINGS

Figure 1:
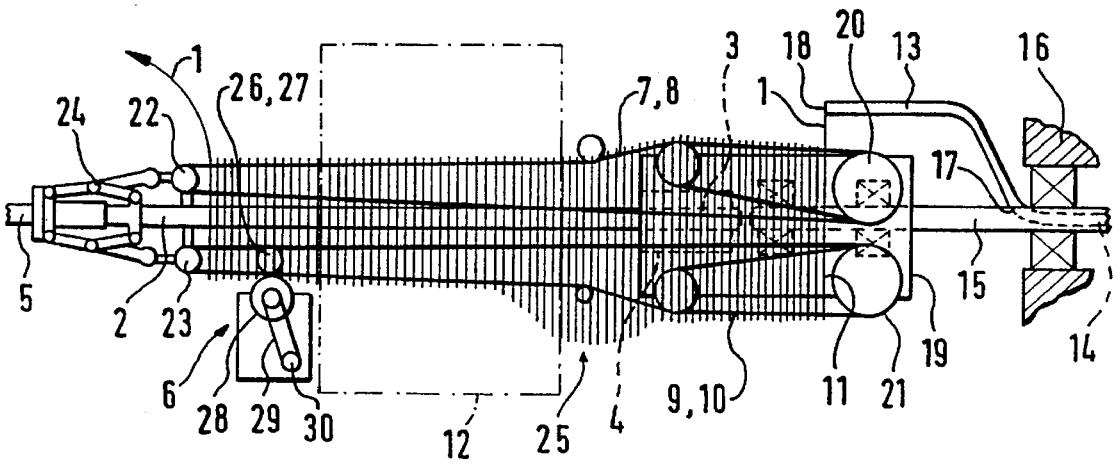
FIG. 1 shows a side view of a device for transporting yarn with a central mast constructed according to preferred embodiments of the present invention.

The device for transporting yarn 1 (in FIG. 1 from right to left) comprises a so-called central mast 2, which is supported at one end 3 in a holding device 4. In the area of the other cantilever-wise end 5, the central mast 2 is supported by a supporting device 6, which will be described in more detail later The central mast 2 is equipped with several, in this case four transport belts 7, 8, 9 and 10. These transport belts 7 to 10 are arranged in polygonal form around the central mast 2, as will be seen clearly from FIG. 3 to be described later. Their purpose is the transport of the yarn 1, which is wound around the central mast 2 and the transport belts 7 to 10 in the form of loops 11. This arrangement serves to transport the greatest possible amount of yarn 1 with predetermined dwell time continuously through a heat setting chamber 12. The depositing of the loops 11 takes place by means of a winding flyer 13, which is arranged at the supported end 3 of the central mast 2. The winding flyer 13 begins in a shaft 15 provided with an axial bore hole 14, the said shaft being supported coaxial to the central mast 2 in a housing 16. The axial bore hole 14 leads into a radial opening 17 of the shaft 15 and is continued by the crank-like formed hollow winding flyer 13 which, together with the shaft 15, is driven to rotate. The yarn 1 to be transported is fed—in FIG. 1 from the right—through the axial bore hole 14 and exits out of the mouth 18 of the winding flyer 13 (the yarn can be a plurality of threads joined together). Due to the rotation of the winding flyer 13 the yarn 1 is wound around the transport belts 7 to 10.

A gear housing 19 is supported on the shaft 15, which housing does not, because of certain means which are not shown here but are known in general, rotate with the shaft 15 and which contains the belt drive for the transport belts 7 to 10. The holding device 4 already mentioned for the supported end 3 of the central mast 2 is installed in this gear housing 19.

In the transport direction from right and left, there are upper and lower guide pulleys 20 and 21 for the transport belts 7 to 10 on the outside of the gear housing 19. In the area of the cantilever-wise projecting end 5 of the central mast 2, freely rotating upper and lower guide pulleys 22 and 23 for the transport belts 7 to 10 are allocated to the respective belts. Shortly before reaching these guide pulleys 22 and 23, the loops 11 of the yarn 1 are unravelled, drawn off and fed to a take-up winder (in a way not shown here). The guide pulleys 22 and 23 are supported adjustably in the distance with respect to each other by means of a tensioning device 24.

For the sake of completeness it should be mentioned that the polygon form of the transport belts 7 to 10 becomes smaller, shortly before reaching the heat setting chamber 12, by means of tensioning pulleys or similar belt guide devices, so that the subsequent shrinking of the yarn 1 in the heat setting chamber 12 is taken into consideration. Because of this, it is schematically indicated in FIG. 1 that the loops 11, in the area 25 shortly upstream of the inlet into the heat setting chamber 12, temporarily hang down freely from the lower transport belts 9 and 10 and only after a while inside the heat setting chamber 12 shrink in such a way that they again lie around or against all of the transport belts 7 to 10.

The supporting device 6 for the central mast 2 is only schematically depicted in FIG. 1. It comprises supported rollers 26 and 27 held on the central mast 2 as well as a supporting roller 28 outside the loops 11 which supports the supported rollers 26 and 27. The supporting roller 28 is driven by a roller drive 30 by means of a continuous drive belt 29. As already mentioned, the intended belt drive in the gear housing 19 for the transport belts 7 to 10 is independent of the roller drive 30.

Figure 2:
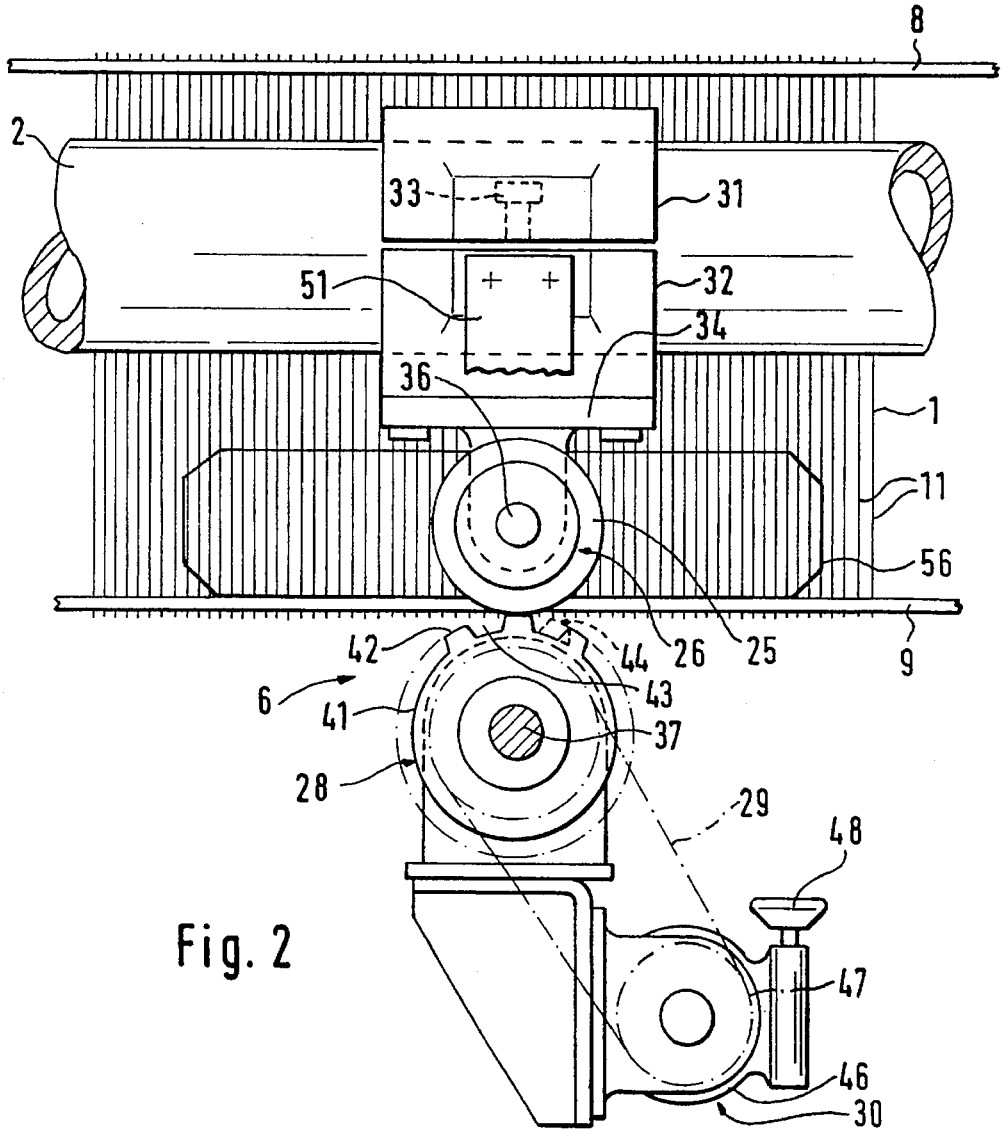
FIG. 2 shows an enlarged partial view of FIG. 1 in the area of the supported rollers and the supporting roller for supporting the central mast, showing preferred embodiments of the present invention.

The supporting device 6, only schematically depicted in FIG. 1 but essential to the invention will now be described in more detail with the aid of FIGS. 2 and 3:

The supporting device 6 comprises two supported rollers 26 and 27 arranged on the central mast 2, which are located inside the loops 11 of the at least one yarn 1, as well as a supporting roller 28 which is arranged outside of the loops 11 and driven by the roller drive 30 by means of the belt 29 marked in dot-dash lines.

Two shell-like brackets 31 and 32 are allocated to the supporting device 6 and are clamped together with the horizontal tube-shaped central mast 2 by means of fastening screws 33. A bearing support 34 is screwed onto the lower bracket 32 in which support the middle section 35 of an axle 36, carrying the supported rollers 26 and 27, is secured. The supported rollers 26 and 27 are thus each arranged freely rotatable, overhung to both sides of the bearing support 34.

The two supported rollers 26 and 27 belonging to the central mast 2 are supported by a supporting roller 28, which preferably extends straight through the machine and to which a plurality of central masts 2 are arranged. The supporting roller arrangement 28 comprises a driven shaft 37, on which per central mast 2, four disks 38, 39, 40 and 41 are tightly coupled. The driven shaft section 37 is rotatably driven by roller drive 30 and belt 29. In preferred embodiments six sets of disks 38, 39, 40, 41, for six respective central masts 2, are provided on a common driven shaft 37.

The disks 38 and 39 are allocated to the supported roller 26, the disks 40 and 41 to the supported roller 27. Each disk 38 to 41 has a supporting surface 42 for the supported roller 26, 27 allocated to it. The width of the individual supporting surfaces 42 is several times the width of a round transport belt 9 or 10, so when a loop 11 passes through the nipping line between the supported rollers 26, 27 and the supporting roller 28, the surface pressure on the yarn 1 is kept to a minimum. In addition, the disks 38 to 41 are provided with longitudinal grooves 43 in the area of their supporting surfaces 42, which grooves are to prevent the yarn 1 getting too crushed when passing through the nipping line. The longitudinal grooves 43 are so arranged that they are a half a groove width in circumferential direction out-of-line to each other on the disks 38, 39 or 40, 41, each of which said disks is allocated to a supported roller 26, 27; this arrangement being marked with a dotted line 44 in FIG. 2. This guarantees that on a supported roller 26 or 27, two longitudinal grooves 43 of neighboring disks 38, 39, 40, or 41 will never be on the nipping line at the same time.

The supported rollers 26 and 27 are each provided with an elastic coating 45 on their running surfaces. This ensures for one that the supported rollers 26 and 27 are driven by the driven disks 38 to 41 by means of friction and with the same circumferential speed as the disks 38, 41, and secondly that the yarn 1 is more carefully treated because the elastic coating 45 on the nipping line can yield somewhat and thus does not crush the loops 11 of the yarn 1 to such a degree.

As the transport belts 7 to 10 are provided with their own belt drive, housed in the gear housing 19, the circumferential speeds of the supported rollers 26, 27 and the supporting roller 28 can be synchronized with the belt speed to such a degree that no difference in speed between it and the transported loops 11 in the area of the nipping line exists. Due to the separate drive of the transport belts 7 to 10, a high bearing pressure need not be generated for the supporting device 6, so that the said supporting device 6 can be restricted to supporting the proportional weight of the central mast 2. It is intended to provide a preferably regulatory, infinitely variable gear 46 for the roller drive 30, the rotational speed of whose driving wheel 47 can be adjusted by means of a hand wheel 48 and which is infinitely variable.

Figure 3:
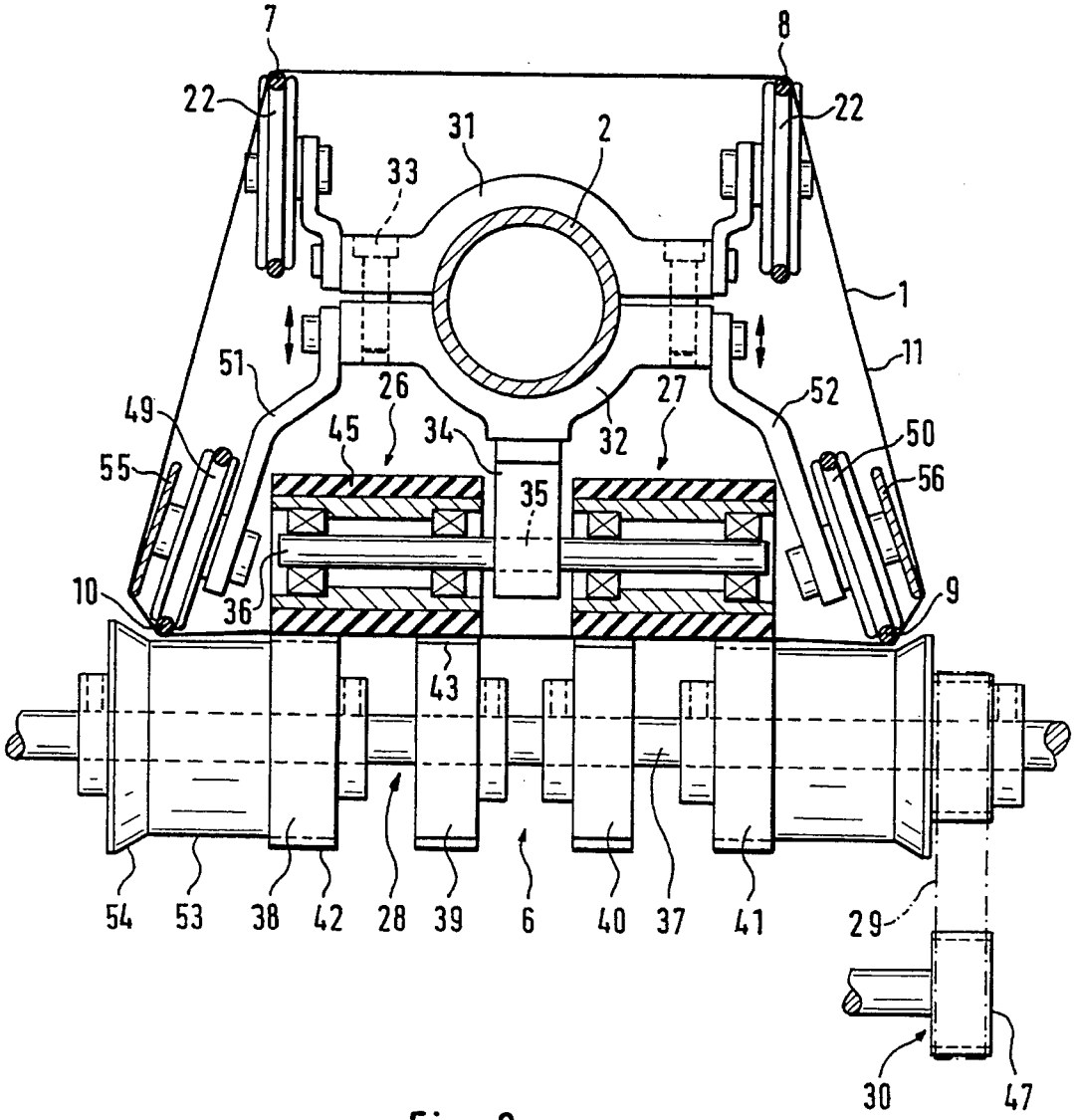
FIG. 3 shows a cross section through the central mast in the area of its supporting device, showing preferred embodiments of the present invention.

According to FIG. 3 each supported roller 26, 27 is allocated a freely rotatable guiding roller 49 or 50, which is driven by the relevant transport belt 10 or 9. These guiding rollers 49, 50 are each screwed over a bent support 51, 52 onto the lower bracket 32 of the central mast 2. The supports 51 and 52 are adjustable in the direction of the relevant double arrow so that the distance from the guiding rollers 49, 50 to the supporting roller 28 is variable. The order is preferably so arranged that there is some clearance between the relevant transport belts 9 and 10 and the supporting roller 28.

The two outer disks 38 and 41 of the supporting roller 28 relative to the central mast 2 are extended outwards by means of cylindrical guiding surfaces 53, whose diameters are the same as the lower diameter of the longitudinal grooves 43 of the disks 38 and 41. In the area of the guiding rollers 49 and 50, these guiding surfaces have sloped surfaces 54 extending slightly outwards at a slant angle, which should guide the loops 11 better in the critical area. The guiding of the loops 11 at the guiding rollers 49, 50 themselves is still aided by stationary yarn guiding elements 55 and 56 which are arranged on the outside.

The upper guide pulleys 22, still recognizable in FIG. 3, lie, as can be seen in FIG. 1, outside of the plane of the supporting device 6, so that they do not hamper the winding of yarn around the upper transport belts 7 and 8 in the support area. The guiding of the loops 11 is additionally simplified in that the transport belts 7 to 10 are arranged in trapezoidal form in cross section, whereby the longer side is located in the area of the guiding rollers 49 and 50. The latter are accordingly arranged slightly slanted to the trapezoid for better guiding of the loops 11.

Figure 4:
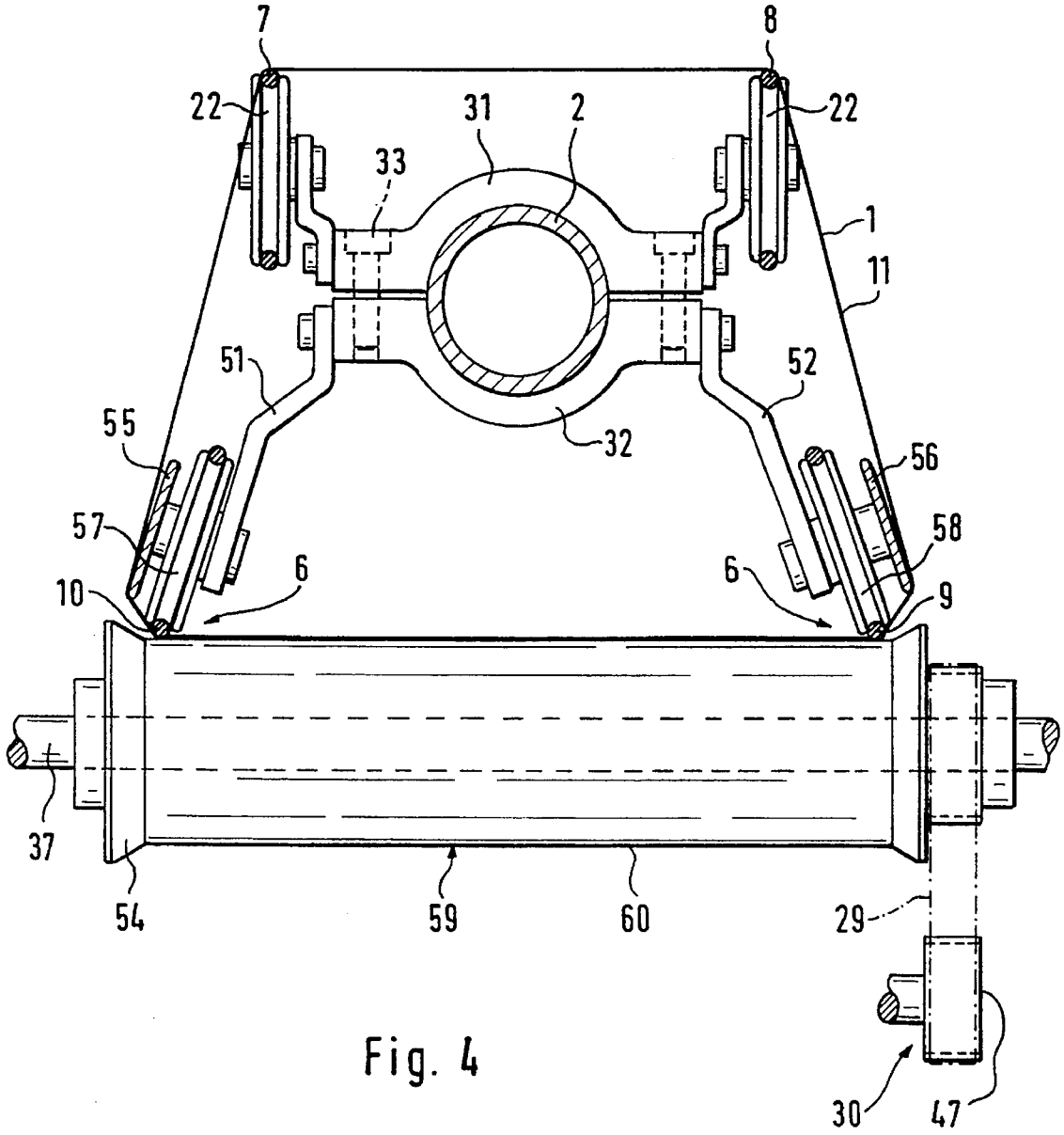
FIG. 4 shows a cross section similar to FIG. 3 of another embodiment of the supporting device of the central mast.

The following variation of a supporting device 6 of the central mast 2 described in FIG. 4 is simplified in design; this construction, however, should be restricted to less sensitive yarns 1. In so far as the components are identical to the embodiment in FIGS. 2 and 3, the same references have been used in FIG. 4. A repetition of the description has thus been omitted.

The variation in FIG. 4 differs mainly from the embodiment so far described in that guiding rollers 57 and 58 are provided for the transport belts 9 and 10, the said guiding rollers 57 and 58 taking over the function of the supported rollers and thus become the supported rollers. This simplified design can in particular be provided when the central mast 2 needs, in principle, no supporting device 6 but is provided with one as a precautionary measure. The guiding rollers or supported rollers 57 and 58 rest with only a very light pressure on a supporting roller 59, the said supporting roller being driven by a roller drive 30 which is preferably infinitely variable and in this case provided with a contact surface 60 with a constant diameter. The guiding rollers or the supported rollers 57, 58 do not lie directly on this contact surface 60, but on the intermediate transport belts 9 and 10. From these, the individual loops 11 are pressed against the contact surface 60 for a short time. Due to the flexibility of the transport belts 9 and 10, in particular under only light pressure, this clamping of the loops 11 is acceptable. The guiding rollers or supported rollers 57 and 58 are driven by the respective transport belts 9 and 10; the speed of the transport belts 9 and 10 is synchronized with the circumferential speed of the supporting roller 59. In the embodiment according to FIG. 4 therefore there does not exist any speed difference either between the loops 11 and the contact surface 60.

Figure 5:
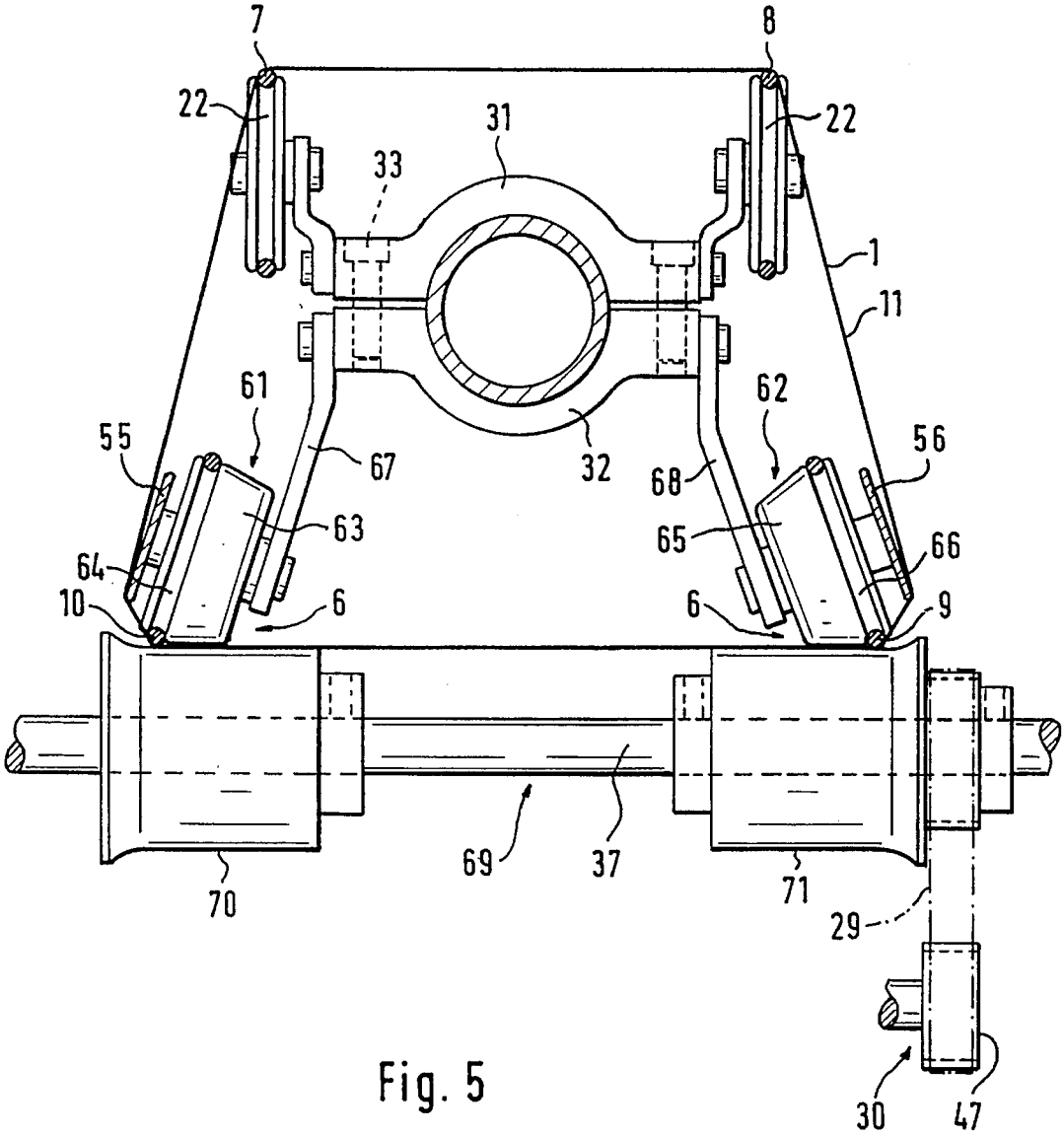
FIG. 5 shows a cross section similar to FIG. 3 of a further embodiment of the invention.

The embodiment according to FIG. 5 differs from that in FIG. 4 only by the fact that the transport belts 9 and 10 do not take up the entire bearing pressure. The supported rollers 61, 62 in this case are integral with and coaxial to the guiding rollers 64, 66 and have special supported surfaces 63, 65 which are supported by the supporting roller 69. The special supported surfaces 63, 65 are slightly conical and, when required, in addition slightly crowned. The supported rollers 61, 62 are secured to the central mast 2 by means of supports 67 and 68. The supporting roller 69 comprises a driven shaft 37, onto which two running disks 70 and 71 are secured which rotate with the shaft 37 and which form the actual supporting surfaces for the supported surfaces 63, 65 of the supported rollers 61 and 62.

The remaining components, insofar as they are not described here, are the same as in the embodiments already described.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A device for transporting yarn, comprising:

a central mast, a plurality of circulating transport belts carried by the central mast, said plurality of transport belts exhibiting yarn support runs which extend longitudinally of the central mast and which are arranged such that they form corners of a polygonal form, a belt drive for driving the transport belts, a yarn winding device for winding yarn in controlled loops around the central mast and transport belts, a first central mast support disposed at a central mast end adjacent the yarn winding device, and a second central mast support disposed spaced from the first mast support in a travel direction of the yarn, said second central mast support including at least one supported roller carried by the central mast, at least one supporting roller having a circumferential support surface engaging a circumferential surface of an associated one of the at least one supported rollers, and a supporting roller drive mechanism for rotatably driving the at least one supporting roller, said supporting roller drive mechanism being independent from the belt drive, wherein said belt drive and said supporting roller drive are operable to drive the supporting roller and supported roller with circumferential speeds synchronized with the belt speeds.

2. A device according to claim 1, wherein said at least one supporting roller is disposed under the at least one supported roller.

3. A device according to claim 1, wherein said second central mast support is located adjacent to an end of the central mast where said yarn is withdrawn from said transport belts.

4. A device according to claim 1, wherein the supporting roller drive comprises an infinitely variable regulatory gear.

5. A device according to claim 1, wherein guiding rollers for the transport belts are provided for respective ones of the supported rollers.

6. A device according to claim 5, wherein the guiding rollers also form the respective ones of the supported rollers.

7. A device according to claim 5, wherein the guiding rollers are supported independently of the respective supported rollers and are freely rotatable.

8. A device according to claim 7, wherein the guiding rollers are adjustable relative to the supporting roller.

9. A device according to claim 5, wherein the guiding rollers are integral with respective ones of the supported rollers.

10. A device according to claim 9, wherein the supported rollers have conical supported surfaces.

11. A device according to claim 5, wherein at least one of the supporting rollers and the supported rollers are provided with an elastic coating.

12. A device according to claim 1, wherein at least one of the supporting rollers and the supported rollers are provided with an elastic coating.

13. A device according to claim 1, wherein the supported rollers have a supported width which is many times that of the width of the transport belts.

14. A device according to claim 1, wherein two supported rollers are provided, to which a common axle is allocated.

15. A device according to claim 1, wherein the supporting roller has a diameter in the area of the supported rollers which is larger than a diameter of the supporting roller intermediate the supported rollers.

16. A device according to claim 15, wherein the supporting roller has two supporting surfaces for every supported roller.

17. A device according to claim 1, wherein the supporting roller is provided with longitudinal grooves.

18. A device according to claim 17, wherein the longitudinal grooves of the two supporting surfaces of the supporting rollers are out-of-line in circumferential direction with respect to each other by about a half a groove width.

19. A device according to claim 1, wherein yarn guiding elements are provided for at least one of the supported rollers and the guiding rollers.

20. A device according to claim 1, wherein said at least one supporting roller is carried by a commonly driven rotatable support shaft which carries corresponding supporting rollers for a plurality of central masts of a yarn treating machine having said masts extending through a common treatment chamber.

21. A device for transporting yarn, comprising:

a central mast, a plurality of circulating transport belts carried by the central mast, said plurality of transport belts exhibiting yarn support runs which extend longitudinally of the central mast and which are arranged such that they form corners of a polygonal form, a belt drive for driving the transport belts, a yarn winding device for winding yarn in controlled loops around the central mast and transport belts, a first central mast support disposed at a central mast end adjacent the yarn winding device, and a second central mast support disposed spaced from the first mast support in a travel direction of the yarn, said second central mast support including at least one supported roller carried by the central mast, at least one supporting roller having a circumferential support surface engaging a circumferential surface of an associated one of the at least one supported rollers, and a supporting roller drive mechanism for rotatably driving the at least one supporting roller, wherein said belt drive and said supporting roller drive are operable to drive the supporting roller and supported roller with circumferential speeds synchronized with the belt speeds, and wherein two supported rollers are provided, to which a common axle is located.

22. A device for transporting yarn, comprising:

a central mast, a plurality of circulating transport belts carried by the central mast, said plurality of transport belts exhibiting yarn support runs which extend longitudinally of the central mast and which are arranged such that they form corners of a polygonal form, a belt drive for driving the transport belts, a yarn winding device for winding yarn in controlled loops around the central mast and transport belts, a first central mast support disposed at a central mast end adjacent the yarn winding device, and a second central mast support disposed spaced from the first mast support in a travel direction of the yarn, said second central mast support including at least one supported roller carried by the central mast, at least one supporting roller having a circumferential support surface engaging a circumferential surface of an associated one of the at least one supported rollers, and a supporting roller drive mechanism for rotatably driving the at least one supporting roller, wherein said belt drive and said supporting roller drive are operable to drive the supporting roller and supported roller with circumferential speeds synchronized with the belt speeds, and wherein the supporting roller has a diameter in the area of the supported rollers which is larger than a diameter of the supporting roller intermediate the supported rollers.

23. A device according to claim 22, wherein the supporting roller has two supporting surfaces for every supported roller.

24. A device for transporting yarn, comprising:

a central mast, a plurality of circulating transport belts carried by the central mast, said plurality of transport belts exhibiting yarn support runs which extend longitudinally of the central mast and which are arranged such that they form corners of a polygonal form, a belt drive for driving the transport belts, a yarn winding device for winding yarn in controlled loops around the central mast and transport belts, a first central mast support disposed at a central mast end adjacent the yarn winding device, and a second central mast support disposed spaced from the first mast support in a travel direction of the yarn, said second central mast support including at least one supported roller carried by the central mast, at least one supporting roller having a circumferential support surface engaging a circumferential surface of an associated one of the at least one supported rollers, and a supporting roller drive mechanism for rotatably driving the at least one supporting roller, wherein said belt drive and said supporting roller drive are operable to drive the supporting roller and supported roller with circumferential speeds synchronized with the belt speeds, and wherein the supporting roller is provided with longitudinal grooves.

25. A device according to claim 24, wherein the longitudinal grooves of the supporting surfaces of the supporting rollers are out-of-line in circumferential direction with respect to each other by about a half a groove width.

* * * * *